US007735604B2

(12) United States Patent
Mikes et al.

(10) Patent No.: US 7,735,604 B2
(45) Date of Patent: Jun. 15, 2010

(54) SILENCER OF EXHAUST GASES, IN PARTICULAR FOR MOTOR VEHICLES

(76) Inventors: Eduard Mikes, MUDr. Frantiska Sovy 63, Vsetin (CZ) 75501; Zdenek Ekart, Havlickova 1644/12, Vsetin (CZ) 75501

( * ) Notice: Subject to any disclaimer, the term of this patent is extended or adjusted under 35 U.S.C. 154(b) by 0 days.

(21) Appl. No.: 12/294,154

(22) PCT Filed: Apr. 21, 2006

(86) PCT No.: PCT/CZ2006/000022

§ 371 (c)(1),
(2), (4) Date: Sep. 23, 2008

(87) PCT Pub. No.: WO2007/110002

PCT Pub. Date: Oct. 4, 2007

(65) Prior Publication Data

US 2009/0223740 A1 Sep. 10, 2009

(30) Foreign Application Priority Data

Mar. 28, 2006 (CZ) ..... 2006-203

(51) Int. Cl.

| | |
|---|---|
| ***F01N 1/00*** | (2006.01) |
| ***F01N 1/08*** | (2006.01) |
| ***F01N 1/10*** | (2006.01) |
| ***F01N 1/24*** | (2006.01) |
| ***F01N 3/08*** | (2006.01) |

(52) U.S. Cl. ..... 181/272; 181/252; 181/255; 181/256; 181/266; 181/267; 181/269; 181/273; 181/276; 422/176; 422/177

(58) Field of Classification Search ..... 181/272, 181/255, 256, 266, 267, 269, 273, 276, 252; 422/176, 177

See application file for complete search history.

(56) References Cited

U.S. PATENT DOCUMENTS 4,487,289 A * 12/1984 Kicinski et al. ..... 181/252

(Continued)

FOREIGN PATENT DOCUMENTS

CZ 196742 7/1979

(Continued)

OTHER PUBLICATIONS

International Search Report for PCT Application No. PCT/CZ2006/000022 (3 pages).

(Continued)

*Primary Examiner*—Jeffrey Donels
*Assistant Examiner*—Christina Russell
(74) *Attorney, Agent, or Firm*—Wood, Herron & Evans, LLP

(57) ABSTRACT

Silencer of exhaust gases, in particular for motor vehicles, comprising an inlet opening (13) and a cylindrical coat (1) provided with an outlet pipe (29) at its opposing end, said cylindrical coat (1) has an internal division into at least four working sections (5, 6, 7, 8) containing axially arranged elements, especially suppression elements, expansion chambers, a whirl chamber, resonators and twirling, deflecting, and accumulating elements, confined with at least three crosswise arranged partitions (2, 3, 4), while the cylindrical coat (1) opposite to the outlet tube (29) is provided with an inlet section (10) freely encompassing its first working section (5) provided with inlet holes (18) of exhaust gases, said inlet section (10) being attached to the surface of the cylindrical coat (1).

16 Claims, 1 Drawing Sheet

U.S. PATENT DOCUMENTS

| | | | | | |
|---|---|---|---|---|---|
| 5,016,438 | A | * | 5/1991 | Harris | 60/299 |
| 5,227,593 | A | * | 7/1993 | Takahashi et al. | 181/255 |
| 5,293,742 | A | * | 3/1994 | Gillingham et al. | 60/288 |
| 5,578,277 | A | * | 11/1996 | White et al. | 422/180 |
| 5,670,756 | A | * | 9/1997 | Ohtaka et al. | 181/256 |
| 6,467,570 | B1 | * | 10/2002 | Herold | 181/231 |

FOREIGN PATENT DOCUMENTS

| | | | |
|---|---|---|---|
| CZ | 284546 | | 11/1998 |
| EP | 0475398 | A1 | 3/1992 |
| EP | 14777642 | A1 | 11/2004 |
| FR | 1116925 | A | 5/1956 |
| WO | 9426412 | | 11/1994 |
| WO | 9844243 | | 10/1998 |

OTHER PUBLICATIONS

Written Opinion of the International Searching Authority for PCT Application No. PCT/CZ2006/000022 (5 pages).

Official Letter from the Czech Patent And Trademark Office from related Czech Application No. PV 2006-203 (2 pages).

* cited by examiner

SILENCER OF EXHAUST GASES, IN PARTICULAR FOR MOTOR VEHICLES

FIELD OF THE INVENTION

The invention relates to a silencer of exhaust gases, in particular for motor vehicles, comprising an inlet opening and a cylindrical coat provided with an outlet piping at the opposite side.

BACKGROUND OF THE INVENTION

A running engine of a motor vehicle produces noise waves whose carrying medium is the pulsating stream of exhaust gases guided by a pipe from the engine to ambient environment. It is known that the intensity of noise decreases in proportion to the increase of losses. Such loss can rise due to absorption of noise energy, for which various filling materials can be used, such as glass wool, or resonators arranged along the stream of exhaust gases. Also the use of perforated walls for the passage of a noise wave is known, or repeated contractions and expansions, or possibly changes of direction of at least a part of the main stream of exhaust gases, further reflections of noise waves and elongation of the path of exhaust gases, or their cooling. The resulting effect of the silencer depends also upon the ratio of the silencer volume to the working volume of the engine cylinders. The present day design trends of silencers of exhaust gases suggest various combinations and respective arrangements of the mentioned suppressing means. For instance a solution is known according to patent CZ 286939 comprising an elongated case with internal space divided by parallel partitions and partitions with gaps at their ends in alternating arrangement, or having openings in their central part, creating a plurality of chambers with increasing volume in the stream direction of exhaust gases. Such solution can suppress the noise waves of exhaust gases, however, by far not meeting the present day requirements relating to their residual intensity.

Yet another solution is known according to CZ PV 1993-2264 that was adversely terminated after its disclosure. It comprises a chamber accommodating a perforated tube provided with a set of small holes and a plurality of rows of larger holes. The perforated tube contains a reflective hollow body created by a pair of cones with a gap between their broad ends. The end of the perforated tube carries a number of larger holes. This solution ensures higher efficiency of noise waves suppression by using an inserted perforated tube with larger holes and smaller ones through which parts of the exhaust gases pass at different distances into the outer zone of the chamber where their mixing and whirling takes place, whereupon they return to the perforated tube. The present day requirements regarding the size of suppression, however, have not been met by this solution, either.

A further embodiment of a silencer is offered by EP 1 477 642 describing a few silencer alternatives comprising, in an elongated case, an input tube penetrating roughly to ⅔ length from one side and an outlet tube penetrating to about ⅔ length from the opposite side. At least one of them is provided by a set of openings. Openings are also created in the carrying partitions of these tubes. This solution ensuring, in the remaining ⅓ length, a compression of stream of exhaust gases, on the one hand side, and the change of their direction and returning to the system of holes in the carrying partition, on the other hand, induces a change of their velocity and turbulence. A higher intensity of suppression of the noise waves in this embodiment is also ensured by a part of the exhaust gases entering into the outlet tube, where the main part of the stream of exhaust gases escaping to free air gets twirled. Nevertheless, such solution does not achieve the intensity of noise wave suppression, either, as required in the present day motor vehicle.

OBJECT OF THE INVENTION

It is the object of the present invention to remove the mentioned disadvantages and drawbacks and to create a silencer of exhaust gases reducing the residual intensity of noise of the engine to a minimum.

This task is met and the mentioned disadvantages and drawbacks are removed by the silencer of exhaust gases, especially for motor vehicles, according to this invention characterised in that the cylindrical coat has an internal division into at least four working sections containing axially arranged elements, especially suppressing elements, expansion chambers, a whirl chamber, resonators and twirling, deflecting and accumulating elements, confined with at least three crosswise arranged partitions, while the cylindrical case opposite to the outlet tube is provided with an inlet section freely encompassing its first working section provided with inlet holes of exhaust gases, said inlet section being attached to the surface of the cylindrical coat.

In a favourable embodiment the intake section is created by a tapered part and a cylindrical part adjacent to it and provided with an annular bottom serving to attach the intake section to the surface of the cylindrical coat at the level of the first partition between the first working section and the second working section, the tapered part being provided with an axially arranged intake opening and a reflecting shield arranged opposite to the same and having the form of a truncated cone provided with a deflecting collar at a distance around its periphery and attached to the internal surface of the tapered part of the intake section.

Another preferable embodiment can have the first working section limited by a cover, the first partition arranged opposite to the same and the corresponding part of the cylindrical coat that is provided with a system of inlet holes in this zone, set holes connecting the internal space of the intake section with the internal space of the first working section accommodating a pair of expansion chambers, the first expansion chamber having a system of through holes at its circumference and a passage tube in its axial part, passing through the second expansion chamber provided with a tangentially oriented first set of intake channels in its coat.

Yet another favourable embodiment has a second working section within the cylindrical coat that is restricted by the first partition and the second partition, comprising, in its internal space, the end part of a second expansion chamber and the end part of the feeding pipe passing coaxially through the first partition that is provided, on the one hand, with a radially arranged set of tube resonators at the circumference of the second expansion chamber which connects the internal space of the first working section with the internal space of the second working section and, on the other hand, also radially arranged sets of bypassing holes, while a perforated tube is arranged opposite the end part of the second expansion chamber and the feeding pipe, said perforated tube passing rigidly through the second partition into the third working section that is provided, at its front end, with a first funnel shield and an accumulation shield behind the same, the perforated tube in front of which is provided with the first set of through channels.

It is also preferable according the invention if the third working section is delimited by the second partition and third partition within its cylindrical coat containing, within its internal space, the central part of the perforated tube passing through the second partition that is provided, on the one hand, with a radially arranged second system of tube resonators at the periphery of the perforated tube, said resonators interconnecting the internal space of the second working section with the internal space of the third working section and, on the other hand, also radially arranged second sets of bypassing holes, the central part of the perforated tube being provided, at a distance from the second set of tube resonators, with a second closed funnel shield in front of which it has a second set of small through channels, whereas behind the same, in the central part of the perforated tube, there is a rigidly accommodated whirl chamber attached by its open end to the third partition around its annual hole and comprises a tangentially orientated second set of inlet channels in its coat.

The fourth working section can be delimited by the third partition and a closing plate in its cylindrical coat and its internal space can comprise the end part of the perforated tube passing through the central part of the third partition ending in front of the outlet pipe.

The sections of single parts of the first set of tube resonators and the second set of tube resonators of the exhaust gas silencer can be rectangular and they can terminate with skew cuts at their free ends. The benefits of the exhaust gas silencer according to the present invention reside in particular in that the exhaust gases from the engine are split at least once during their passage into a plurality of partial streams, the partial noise waves being phase shifted and their wavelengths being changed. Upon entering into the internal, i.e. the mixing space of the second working section, all partial noise waves interfere, producing the so-called acoustic combination resulting in a decrease of noise level. This interference represents the main part of the suppressing process. The low resistance against the flow of exhaust gases through the silencer and the efficient interference of noise waves under simultaneous lower counter-pressure enable also lower fuel consumption, as compared with other exhaust gas silencers. As evidenced by testing, the residual intensity of noise waves at the outlet of the silencer according to the invention is substantially lower than in the known silencer embodiments.

DESCRIPTION OF THE DRAWINGS

A preferable embodiment of the invention is illustrated in the drawing representing an axonometric view and a partial section through the silencer of exhaust gases, in particular for motor vehicles

EXAMPLES OF EMBODIMENT OF THE INVENTION

Figure 1:
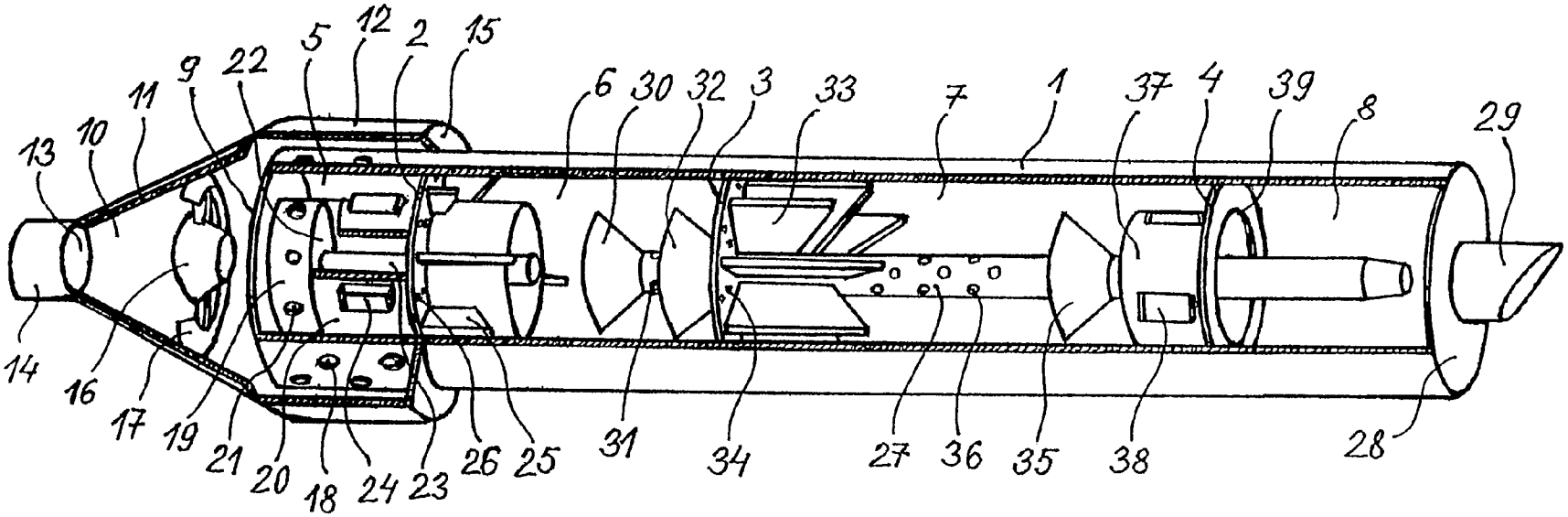

The silencer according to the present invention as shown in the present example consists of a cylindrical coat 1 with internal space divided crosswise with at least two partially passable transitions 2, 3 and one not passable partition 4. The first working section 5 is closed with cover 9 in front of which the inlet section 10 is arranged that consists of tapered part 11 and cylindrical part 12 following one another and being connected. The tapered part 11 is provided with an axially arranged inlet opening 13 for exhaust gases following after the inlet tube 14. The cylindrical part 12 of the intake section 10 freely girdles the cylindrical coat 1 in the zone of its first working section 5 and at the level of partition 2 it is hermetically attached by its annular bottom 15 to the surface of cylindrical coat 1. The tapered part 11 of the intake section 10 creating a diffuser bears an axially arranged reflection shield 16 in the shape of a truncated cone provided, at a distance around its circumference, with a deflection collar 17 attached to the internal surface of the tapered part 11 of intake section 10.

Within the zone between cover 9 and the annular bottom 15 the whole periphery of cylindrical coat 1 is provided with a system of feeding openings 18 connecting the internal space of intake section 10 with the internal space of the first working section 5. The latter accommodates a pair of expansion chambers c19, 20 of which the first expansion chamber 19 is rigidly attached to the internal wall of cover 9 and has a system of through holes 21 at its periphery. This first expansion chamber 19 is followed by a rigidly attached second expansion chamber 20 that is divided from the first expansion chamber 19 with an annular partition 22 whose central part anchors the feeding tube 23 interconnecting the internal space of the first expansion chamber 19 with the internal space of the second working section 6 and passing through the second expansion chamber 20. The coat of this second expansion chamber 20 is provided with the tangentially oriented first set of inlet channels 24 and passes through the first partition 2 into the second space of the second working section 6, coaxially with feeding tube 23 where it is fully open. The first partition 2 accommodates the first set of tube resonators 25 that is radially attached at the outer periphery of the second expansion chamber 20, said resonators interconnecting the internal space of the first working section 5 with the internal space of second working section 6. Single parts of the third set of tube resonators 25 have skew cuts at their free ends and their section is not specified. Their section in the represented embodiment is rectangular and their lengths are different. Between the separate parts of the first set of tube resonators 25, the first partition 2 at the outer periphery of second expansion chamber 20 is provided with radially arranged first set of bypass holes 26.

At the opposite side, at a distance from passage tube 23 the internal space of second working section 6 accommodates axially a perforated tube 27 passing through second partition 3, to which it is attached, to the third working section 7 and further through the third partition 4 into the fourth working section 8 where it freely ends in front of the closing plate 28 closing the fourth working section 8. The closing plate 28 is provided with an outlet pipe 29 of exhaust gases.

The front end of perforated tube 27 carries the third closed funnel shield 30 and at a distance behind the shield the perforated tube 27, having a first set of channels 31 in this part, carries the accumulation shield 32 overlapping the diameter of the first closed funnel shield 30. The bottom of accumulation shield 32 is followed by second partition 3. It accommodates the second set of tube resonators 33 that is attached radially at the outer periphery of perforated tube 27, said resonators interconnecting the internal space of the second working section 6 with the internal space of the third working section 7. The single parts of the second set of tube resonators 33 have skew cuts at their free ends and the shape of their section is not defined. The section according to the example of the embodiment is rectangular and the lengths are different. Between the separate parts of the second set of tube resonators 33 the second partition 3 at the outer periphery of perforated tube 27 is provided with a radially arranged second set of bypass holes 34. At a distance from the second set of tube resonators 33 the perforated tube 27 is provided with a second closed funnel shield 35 in front of which there is a second set of through channels 36. Behind the closed funnel shield 35 the third working section 7 accommodates the whirl chamber 37 whose coat is provided with a tangentially orientated second set of inlet channels 38. One end of the whirl chamber 37 is attached to perforated tube 27 while the other end, the open one, mouthing into the fourth working section 8, is attached to the third partition 4 around its annular opening 39.

The silencer of exhaust gases according to the present invention operates as follows:

The exhaust gases leaving a not illustrated engine, e.g. a combustion engine, are guided through the inlet tube 14 and the inlet opening 13 to the expansion space of the intake section 10 operating as a diffuser wherein a part of exhaust gases impacts against the reflection shield 16 and a part through the deflection collar 17 upon the cover of the cylindrical coat 1 of the silencer. This brings about a turbulent action and a phase shift of the noise waves of the exhaust gases proceeding further through the feeding openings 18 into the internal space of the first r working section 5. By contraction in the feeding openings 18 and the following expansion in the internal space of the first working section 5 the noise wave gets suppressed. The exhaust gases stream from the mentioned space, on the one hand, by way of the through holes 21 into the first expansion chamber 11 and further through feeding tube 23 into the internal space of the second working section 6 and, on the other hand, through the tangentially orientated first set of inlet channels 24 into the second expansion chamber 20 wherein a strong turbulence of exhaust gases results from their tangential orientation, whereupon the gases enter freely the internal space of the second working section 6. Also the exhaust gases from the working section 5 enter the same, and namely through the radially arranged first set of tube resonators 25 whose skew cut prevents the resonation effect, and further through the first sets of bypass holes 26 in the first partition 2. The mixing of partial streams occurs in the second working section 6, and namely the stream of exhaust gases leaving the first set of bypass holes 26 from the first working section 5 through the feeding tube 23 from the first expansion chamber 19 and through the free outlet from the second expansion chamber 20 and, finally, the stream of exhaust gases leaving the first system of tube resonators 25. This stream of exhaust gases has a phase delay of wave propagation due to the passage through the first set of tube resonators 25. The interference brought about between both streams in the internal space of the second working section 6 results in reducing, i.e. suppressing the noise energy. Exhaust gases in the internal, i.e. the mixing space of the second working section 6 impinge first of all the closed funnel shield 30 improving the interference of both streams of exhaust gases and, at the same time, the resulting noise wave and the character of streaming prior to the next split become homogenised. Then a part of the adapted exhaust gases enter, under the assistance of the accumulation shield 32, the first set of through channels 31 and the perforated tube 27, the prevailing part of the gases streaming through the second set of bypass holes 34 in the second partition 3 and the second set of tube resonator 33 into the third working section 4, operating both as a mixing element and a divider of the exhaust gas stream. One part of exhaust gases with homogenized noise wave streaming through perforated tube 27 gets from the same into the internal space if the third working section 5 through the second set of through channels 36. Due to the passage through this second set of through channels 36 the noise wave carried through this part of the stream gets silenced. A partial stream of exhaust gases leaving the second set of tube resonators 33 has again a phase shift of their noise range due to those resonators. By action of the second closed funnel shield 35 another interference of the noise range of all partial streams is brought about in this mixing internal space of working section 7, which leads to further noise suppression. A part of exhaust gases enters, by way of the said through channels 36, the perforated tube 27 guiding them into the internal space of the fourth working section 8. Yet another part of exhaust gases enters the tangentially oriented second set of inlet channels 38 and proceeds to the whirl chamber 37 where a further strong whirl of exhaust gases is brought about due to their tangential orientation, and then the exhaust gases leave the whirl chamber 37 through the annular opening 39 in the third partition 4 and proceed to the fourth working section 8. Here both streams of exhaust gases get mixed shortly before entering the outlet pipe 29 and under the ejection effect of a part of exhaust gases leaving the end of perforated tube 27 they get out to the ambient atmosphere through outlet pipe 29.

INDUSTRIAL UTILISATION

The silencer of exhaust gases according to the present invention can be used with advantage in motor vehicles whenever high values of noise suppression are required.

List of reference numbers

1. cylindrical coat
2. first partition
3. second partition
4. third partition
5. first working section
6. second working section
7. third working section
8. fourth working section
9. cover
10. intake section
11. tapered part
12. cylindrical part
13. inlet opening
14. inlet tube
15. annular bottom
16. reflection shield
17. deflection collar
18. feeding opening
19. first expansion chamber
20. second expansion chamber
21. through hole
22. annular partition
23. feeding tube
24. first set of inlet channels
25. first set of tube resonators
26. first set of bypass holes
27. perforated tube
28. closing plate
29. outlet pipe
30. first closed funnel shield
31. the first set of through channels
32. accumulation shield
33. second set of tube resonators
34. second set of bypass holes
35. second closed funnel shield
36. second set of through channels
37. whirl chamber
38. second set of inlet channels
39. annular opening

The invention claimed is:

1. Silencer of exhaust gases, in particular for motor vehicles, comprising an inlet opening and a cylindrical coat provided with an outlet pipe at its opposing end, the cylindrical coat is internally divided into at least four working sections containing axially arranged suppression elements, expansion chambers, a whirl chamber, resonators and twirling, deflecting and accumulating elements, confined with at least three crosswise arranged partitions, the cylindrical coat opposite to the outlet tube being provided with an inlet section freely encompassing a first of said working sections which is provided with inlet holes for exhaust gases, said inlet section being attached to the surface of the cylindrical coat, characterized in that the inlet section is created by a tapered part and a cylindrical part adjacent to it and provided with an annular bottom serving to attach the inlet section to the surface of the cylindrical coat at the level of a first of said partitions between the first working section and a second of said working sections, the tapered part being provided with an axially arranged intake opening and a reflection shield arranged opposite the same and having the form of a truncated cone provided with a deflecting collar with a deflecting collar at a distance around its periphery and attached to the internal surface of the tapered part of the inlet section.

2. Silencer of exhaust gases, in particular for motor vehicles, comprising an inlet opening and a cylindrical coat provided with an outlet pipe at its opposing end, the cylindrical coat is internally divided into at least four working sections containing axially arranged suppression elements, expansion chambers, a whirl chamber, resonators and twirling, deflecting and accumulating elements, confined with at least three crosswise arranged partitions, the cylindrical coat opposite to the outlet tube being provided with an inlet section freely encompassing a first of said working sections which is provided with inlet holes for exhaust gases, said inlet section being attached to the surface of the cylindrical coat, characterized in that the first working section limited by a cover, a first of said partitions arranged opposite to the same and the corresponding part of the cylindrical coat that is provided with a system of inlet holes in this zone, set holes connecting the internal space of the inlet section with the internal space of the first working section accommodating a pair of expansion chambers, the first expansion chamber having a system of through holes at its circumference and a passage tube in its axial part, passing through the second expansion chamber provided a tangentially oriented first set of intake channels in its coat.

3. Silencer of exhaust gases, in particular for motor vehicles, comprising an inlet opening and a cylindrical coat provided with an outlet pipe at its opposing end, the cylindrical coat is internally divided into at least four working sections containing axially arranged suppression elements, expansion chambers, a whirl chamber, resonators and twirling, deflecting and accumulating elements, confined with at least three crosswise arranged partitions, the cylindrical coat opposite to the outlet tube being provided with an inlet section freely encompassing a first of said working sections which is provided with inlet holes for exhaust gases, said inlet section being attached to the surface of the cylindrical coat, characterized in that a second of said working sections within the cylindrical coat is restricted by a first of said partitions and a second of said partitions, comprising, in its internal space, the end part of a second expansion chamber and the end part of a feeding tube passing coaxially through the first partition that is provided, on the one hand, with a radially arranged set of tube resonators at the circumference of the second expansion chamber, which connects the internal space of the first working section with the internal space of the second working section and, on the other hand, also a radially arranged sets of bypassing holes, while a perforated tube is arranged opposite the end part of the second expansion chamber and the feeding tube, said perforated tube passing rigidly through the second partition into a third of said working sections that is provided, at its front end, with a first funnel shield behind which an accumulation shield is arranged, and the perforated tube in front of which has a first set of through channels.

4. Silencer of exhaust gases, according to claim 3, characterized in that each part of the tube resonators of the exhaust gas silencer terminate with skew cuts at a free end thereof.

5. Silencer of exhaust gases according to claim 3 characterized in that each part of the tube resonators of the exhaust gas silencer is rectangular in section.

6. Silencer of exhaust gases according to claim 5 characterized in that each part of the tube resonators of the exhaust gas silencer terminate with skew cuts at a free end thereof.

7. Silencer of exhaust gases, in particular for motor vehicles, comprising an inlet opening and a cylindrical coat provided with an outlet pipe at its opposing end, the cylindrical coat is internally divided into at least four working sections containing axially arranged suppression elements, expansion chambers, a whirl chamber, resonators and twirling, deflecting and accumulating elements, confined with at least three crosswise arranged partitions, the cylindrical coat opposite to the outlet tube being provided with an inlet section freely encompassing a first of said working sections which is provided with inlet holes for exhaust gases, said inlet section being attached to the surface of the cylindrical coat, characterized in that a third of said working sections is delimited by a second of said partitions and a third of said partitions within its cylindrical coat containing, within its internal space, the central part of a perforated tube passing through the second partition that is provided, on the one hand, by a radially arranged second set of tube resonators at the periphery of the perforated tube, said resonators interconnecting the internal space of a second of said working sections with the internal space of the third working section and, on the other hand, also radially arranged second sets of bypassing holes, the central part of the perforated tube being provided, at a distance from the second set of tube resonators, with a second closed funnel shield in front of which it has a second set of small through channels, whereas behind the same, upon the central part of the perforated tube, a whirl chamber is rigidly attached by an open end thereof to the third partition around an annular hole thereof and having a tangentially orientated second set of inlet channels in its coat.

8. Silencer of exhaust gases according to claim 7, characterized in that a fourth of said working sections is delimited by the third partition and a closing plate in its cylindrical coat and its internal space comprises an end part of the perforated tube passing through a central part of the third partition ending in front of the outlet pipe.

9. Silencer of exhaust gases according to claim 7 characterized in that each part of the tube resonators of the exhaust gas silencer terminate with skew cuts at a free end thereof.

10. Silencer of exhaust gases according to claim 7, characterized in that the second working section is delimited by a first of said partitions and the second partition, and the first working section is delimited at one end by the first partition.

11. Silencer of exhaust gases according to claim 7 characterized in that each part of the tube resonators of the exhaust gas silencer is rectangular in section.

12. Silencer of exhaust gases according to claim 11, characterized in that each part of the tube resonators of the exhaust gas silencer terminate with skew cuts at a free end thereof.

13. Silencer of exhaust gases according to claim 5, characterized by a first set of tube resonators which connecting the internals space of the first working section with the internal space of the second working section.

14. Silencer of exhaust gases according to claim 13 characterized in that each part of the first set of tube resonators and each part of the second set of tube resonators of the exhaust gas silencer are rectangular in section.

15. Silencer of exhaust gases according to claim 14, characterized in that each part of the first set of tube resonators and each part of the second set of tube resonators of the exhaust gas silencer terminate with skew cuts at a free ends thereof.

16. Silencer of exhaust gases according to claim 13, characterized in that each part of the first set of tube resonators and each part of the second set of tube resonators of the exhaust gas silencer terminate with skew cuts at a free ends thereof.

* * * * *

UNITED STATES PATENT AND TRADEMARK OFFICE

CERTIFICATE OF CORRECTION

PATENT NO. : 7,735,604 B2
APPLICATION NO. : 12/294154
DATED : June 15, 2010
INVENTOR(S) : Eduard Mikes et al.

It is certified that error appears in the above-identified patent and that said Letters Patent is hereby corrected as shown below:

Column 2
Line approximately 65, "according the invention" should be -- according to the invention --

Column 4
Line 9, "c19" should be -- 19 --

Column 5
Line approximately 14, "first r working" should be -- first working --
Line approximately 47, "homogenised" should be -- homogenized --
Line approximately 56, "space if the third" should be -- space of the third --

Column 7
Line 60, "arranged sets" should be -- arranged set --

Column 8
Line 3, "terminate with" should be -- terminates with --
Line 9, "terminate with" should be -- terminates with --
Line 48, "terminate with" should be -- terminates with --
Line 58, "terminate with" should be -- terminates with --
Line 60, "resonators which connecting" should be -- resonators connecting --

Column 9
Line 4, "at a free ends" should be -- at free ends --

Column 10
Line 2, "at a free ends" should be -- at free ends --

Signed and Sealed this

Nineteenth Day of October, 2010

David J. Kappos

David J. Kappos
*Director of the United States Patent and Trademark Office*